United States Patent [19]

Swiatosz

[11] Patent Number: 4,818,843

[45] Date of Patent: Apr. 4, 1989

[54] SMOKE GENERATOR

[76] Inventor: Edmund Swiatosz, 335 Lake Seminary Cir., Maitland, Fla. 32751

[21] Appl. No.: 155,376

[22] Filed: Feb. 12, 1988

[51] Int. Cl.[4] ..... H05B 3/48

[52] U.S. Cl. ..... 219/275; 219/272; 219/271; 219/300

[58] Field of Search ..... 219/271, 272, 273, 274, 219/275, 276, 300, 302, 303, 305

[56] References Cited

U.S. PATENT DOCUMENTS

| | | | |
|---|---|---|---|
| 1,367,463 | 2/1921 | Christian | 219/303 |
| 2,291,423 | 7/1942 | Tiscornia | 219/273 |
| 3,851,146 | 11/1974 | Bennett | 219/300 |
| 3,970,816 | 7/1976 | Hosokawa | 219/523 |
| 3,990,987 | 11/1976 | Rogers | 219/300 |
| 4,034,203 | 7/1977 | Cooper | 219/275 |
| 4,547,656 | 10/1985 | **Swiatosz** | **219/272** |
| 4,568,820 | 2/1986 | Swiatosz | 219/273 |

*Primary Examiner*—Teresa J. Walberg

*Attorney, Agent, or Firm*—William M. Hobby, III

[57] ABSTRACT

A smoke generator apparatus has a housing with an electrical pump mounted in the housing and connected to a fluid reservoir filled with a fluid for generating smoke. A coiled electical resistance heating tube is mounted in the housing and forms an electrical resistance in an electrical circuit. The coiled electrical resistance heating tube has a thin coating of an electrical insulating, thermal conducting material, such as a thin coating of boron nitride thereon which electrically isolates the coils of the coiled electrical resistance heating tube while conducting heat through the coils from the hot to the cold end of the coiled electrical resistance heating tube. The coiled electrical resistance heating tube has one end operatively connected to the pump and the other end forming an outlet for dispensing superheated vapors into the ambient air for condensation into smoke particles. A pair of thermostats is mounted at different positions on the coated coiled electrical resistance heating tube for sensing the temperature therein for controlling heater temperature and actuating the pump for pumping the fluid from the reservoir into the resistance heating tube for generating the smoke.

22 Claims, 2 Drawing Sheets

SMOKE GENERATOR

BACKGROUND OF THE INVENTION

The present invention relates generally to smoke and fog generators and especially to a low cost, fast startup resistance tube smoke generator.

A variety of training devices are available for generating nontoxic smoke for educational, theater, aerosol dispensing purposes. One such device of the prior art simulates smoke by utilizing steam mixed with an organic liquid so as to produce a vaporized organic liquid, and forcing the vaporized organic liquid through a narrow orifice into the atmosphere so that the vapor is rapidly chilled. While performing satisfactorily for its intended purpose of generating smoke, this prior art device ordinarily leaves something to be desired, especially from the standpoints of design complexity, cost effectiveness, energy utilization efficiency, and physical size.

In addition, there are commercially available a variety of smoke bombs or smoke grenades for generating smoke. These devices work well for their intended purpose of producing smoke, but leave something to be desired from the standpoints of cost effectiveness and personal safety, in that the smoke produced thereby may be toxic.

U.S. Pat. No. 2,882,240 to Charwat discloses a smoke generator primarily for use in a wind tunnel, that heats oil to a temperature below its boiling point and plays cool air over the oil to condense the vapor. The resulting smoke is removed through tubes of relatively large diameter.

U.S. Pat. No. 3,234,357 to Seuthe discloses an electrically heated smoke producing device in which a tubular element having a capillary bore through which an electrical heating element extends that is suspended in a liquid which will vaporize to form smoke when heated.

U.S. Pat. No. 3,250,723 to Fortney discloses a portable smoke generator that has a converter element which is heated, and sprayed with a smoke-producing fuel. A stream of air is directed by the converter to cause movement of the smoke from the converter.

U.S. Pat. No. 4,326,119 to the present inventor is the most relevant art. It discloses a portable battery-powered electric smoke generator for simulating the smoke of a fire for training purposes, that includes a tubular housing enclosing a rechargeable battery power supply having terminals connected to the ends of a tubular metallic coil filled with a vaporizable smoke producing liquid. One end of the tubular coil communicates with a smoke discharge port at one end of the housing. The discharge port is sealed by a fusible disk and communicates with an apertured smoke release cup. An electric switch arrangement, either thermal or electronic, is provided on the housing in the circuit between the coil and power supply for energizing the tubular coil for a time sufficient to superheat the vaporizable liquid therein. The heat of the tubular coil melts the fusible disk to release the superheated liquid through the smoke release cap into the atmosphere as a vapor simulating smoke. The liquid may be mineral oil, polyethylene glycol or propylene glycol.

U.S. Pat. No. 4,349,723 to the present inventor discloses a non-toxic smoke generator for simulating the smoke of a fire, that includes an inner cylindrical shell surrounded in spaced relation by a thermally insulated outer casing to form an air flow passage therebetween through which compressed air heated by electric air heaters is caused to flow in a helical pattern to heat the shell to a temperature above the vaporization temperature of a vaporizably smoke substance. The smoke substance, such as propylene glycol, polyethylene glycol 200 or mineral oil, is pumped from a reservoir through a supply pipe having a coiled preheating portion disposed in the space between the shell and housing and is sprayed through a wide spray atomizing nozzle into heated vaporization chamber where it is vaporized and discharged as non-toxic smoke.

U.S. Pat. No. 4,477,395 to Albarda discloses apparatus for admixing liquid anesthetics and respiratory gas to be supplied to a patient. The apparatus comprises a mixing chamber having an inlet for receiving the liquid anesthesia and the respiratory gas, and an outlet for supplying the mixture. A feed line is provided in the inlet for the liquid anesthesia, with a heat exchanger for equalizing the inlet temperatures of the anesthesia and respiratory gas. Temperature sensors are provided in the inlet and the outlets with a circuit for determining the difference between the temperatures. Without heating of the chamber, this difference is proportional to a ratio between the evaporated anesthetic and respiratory gas. With the chamber heated to equate the inlet and outlet temperatures, the amount of heating is proportional to the flow of anesthetic to the chamber.

In addition to these prior patents, the Applicant has also disclosed a beryllium oxide ceramic disc utilized to isolate the electrical circuit associated with the heating function of a long coiled thin wall tube smoke generator system from the other components of the smoke generator.

Other U.S. patents of interest may be seen in the U.S. Pat. Nos. 3,242,098, to Andrews; Kenney 3,255,967; Kerivily 3,355,571; Curtis et al 3,458,948; Slater et al 3,496,668; and Stevens et al 4,343,719. These patents show various smoke generators, foggers, and aerosol producers which are electrically operated and with heating coils. In addition to these, there are smoke generators, foggers, and aerosol producers which operate on propane or other liquid or gaseous fuels and which operate from the exhaust of automobile or lawnmower engines.

The present invention is an improvement on my prior U.S. patents and inventions and provides for a smoke, fog, or aerosol producer having a coiled electrical resistance heating tube mounted in an electrical circuit for applying an electrical voltage thereacross to heat the coil for heating a liquid being fed thereinto to produce smoke particulates by condensation of the superheated vapors in the ambient air. The tubing in this case is coated with a thin coating which allows the coil loops to almost abut against each other because of the electrical insulation of the coating while producing a high thermoconducting material of conducting heat rapidly through the coils to speed up the flow of heat from the hot end to the cold end of the coiled electrical resistance heating tube. This allows inexpensive thermostats to be used to measure the temperature at positions on the tube to operate a pump to feed a smoke agent material thereto when the tube reaches a predetermined temperature and to maintain heater temperature. The aim of the invention is to permit the use of a low cost thermostat in place of expensive solid state temperature controls while retaining the fast startup feature of a resistance tube smoke generator.

SUMMARY OF THE INVENTION

The present invention relates to a smoke generator, fogger, or aerosol generator having a housing with an electric pump mounted in the housing and connectable through a switch to an electrical power source. A fluid reservoir is mounted in or adjacent to the housing and operatively connected to the pump. The reservoir may be filled with a propylene glycol fluid or other smoke generating composition. A coiled electrical resistance heating tube is mounted in the housing and forms an electrical resistance in an electrical circuit. The coiled electrical resistance heating tube has a thin coating of an electrical insulating thermally conducting material, such as a boron nitride coating, which electrically isolates the coil while conducting heat between the hot and cold ends of the coiled electrical resistance heating tube. The coiled electrical resistance heating tube has one end operatively connected to the pump. A smoke outlet may be attached or formed on the other end of the coiled electrical resistance heating tube for directing smoke generated in the coiled electrical resistance heating tube therefrom from a propylene glycol or mineral oil formulation in said reservoir to produce smoke particulates by condensation of superheated vapors being fed in the ambient air. Sensing thermostats sense the temperature in at least one position but preferably in two positions along the coiled electrical resistance heating tube and actuate a switch for switching the pump on and off responsive to the thermostat sensing predetermined temperatures so that vapor is generated in the coiled electrical resistance heating tube from the smoke agent material upon the tube reaching a predetermined temperature and the pump being switched on to pump fluid from the reservoir of smoke agent material through the coiled electrical resistance heating tube and out the tube to form smoke particulates upon condensation of the superheated vapors in the ambient air. cl

BRIEF DESCRIPTION OF THE DRAWINGS

Other objects, features, and advantages of the present invention will be apparent from the written description and the drawing in which.

DESCRIPTION OF THE PREFERRED EMBODIMENT

Figure 1:
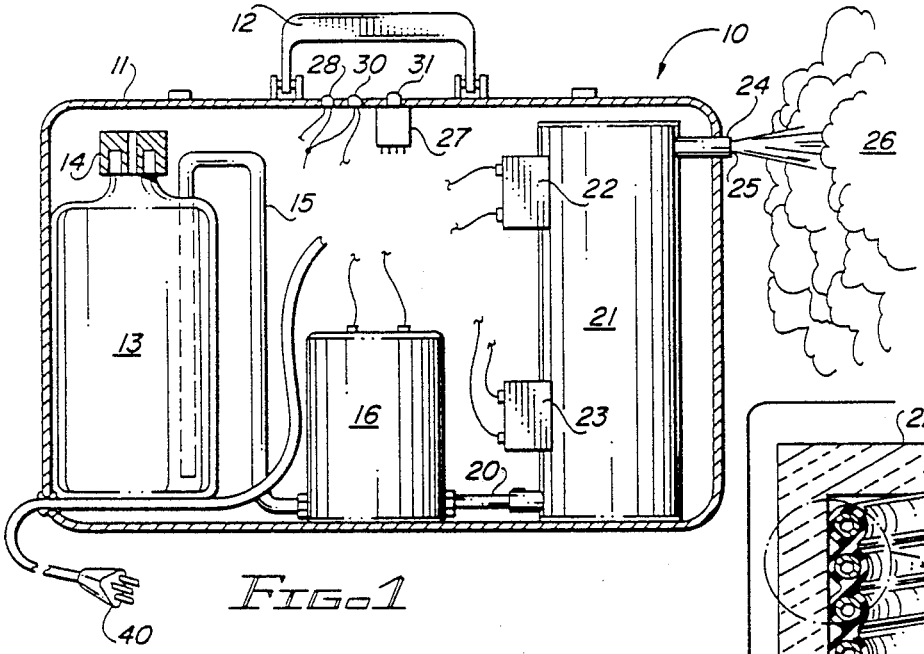
FIG. 1 is a sectional view of a smoke or aerosol generator in accordance with the present invention.
Figure 2:
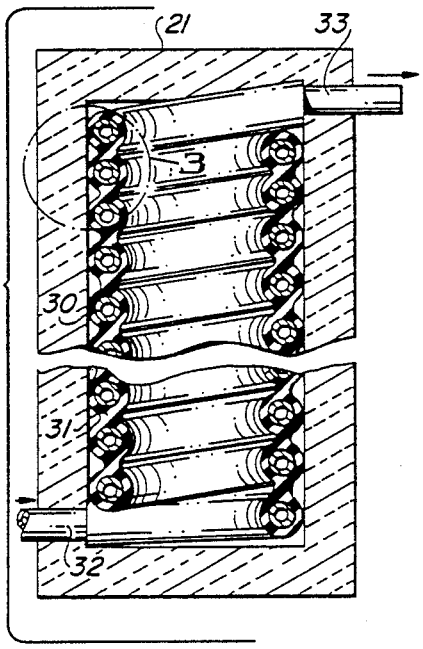
FIG. 2 is a sectional view taken through the heating shield and heating coils.
Figure 3:
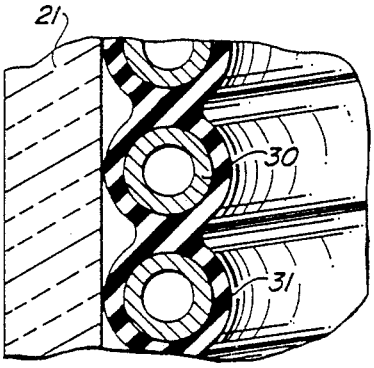
FIG. 3 is a sectional view taken on the circle 3 of FIG. 2.

Referring to the drawings and especially to FIGS. 1 through 3, a smoke generator 10, which may also be a fogger or aerosol generator for generating a simulated smoke for use in training, insect control, and the like, is illustrated having a portable housing 11 with a handle 12 mounted to the top thereof. The housing 11 has a reservoir 13 mounted therein having a filling cap and vent 14 on the top thereof and a tube 15 extending from the reservoir 13 and into an electrical pump 16. The electrical pump may be driven by an electrical motor therein which may include gearing and will pump the liquid in any manner desired such as in a diaphragm pump. The electrical pump 16 has a pair of electrical conductors extending therefrom and an exit fluid tube 20 preferably made of plastic for electrical isolator extending from the pump 16 into a heat insulating container 21. The container 21 can be seen having a top thermostat 22 mounted thereto and a bottom thermostat or delay timer 23. A nozzle or outlet 24 extends through an opening 25 in the housing 11 and is shown dispensing a simulated smoke, fog or aerosol 26. The housing 11 also can be seen to have a switch 27 mounted therein along with a power light 28 extending therethrough and a ready light 30 extending through the housing 11. Switch 27 has an actuating button 31 extending through the housing 11.

As seen in FIGS. 2 and 3, the coil housing 21 is an insulating or shielding material for the heat generated in the coil 30. The coil 30 is used as an electrical resistance heating element for generator smoke particulates therein by producing a superheated vapor which is fed into the atmosphere. A long coiled thin wall tube 30 may have a ⅛ inch diameter with a 0.005 wall thickness tube with a length between 20 and 35 feet depending on the operating temperature as desired. The preferred material is a nickel chromium alloy, such as INCONEL, but tubes of stainless steel or other materials may also be utilized. The coils are shown coated with a thin coating of electrical insulating material that has special thermal conductivity properties. The material may be a boron nitride coating, such as a type V produced by Sohio, Carborundum Company, specifically for a high thermal conductivity. A powered boron nitride (75%) in a binder such as aluminum phostate is preferred but other binders such as aluminum or magnesium maybe used with 70–95% powered boron nitride. The coating 31 allows the coils 30 to be placed abutting each others but being insulated from each other by the coating 31 to prevent coils from electrically shorting directly between each other rather than the current flowing through the entire coil to produce the heating within the coil. However, heat is transferred rapidly from the hot end of the coil to the colder end by the high thermal conductive properties of the coating material without having to follow the tube in a coiled circle from one end to the other. The coil has an inlet 32 and an outlet 33 which is part of the outlet 24 extending through the opening 25 in the housing 11.

Figure 4:
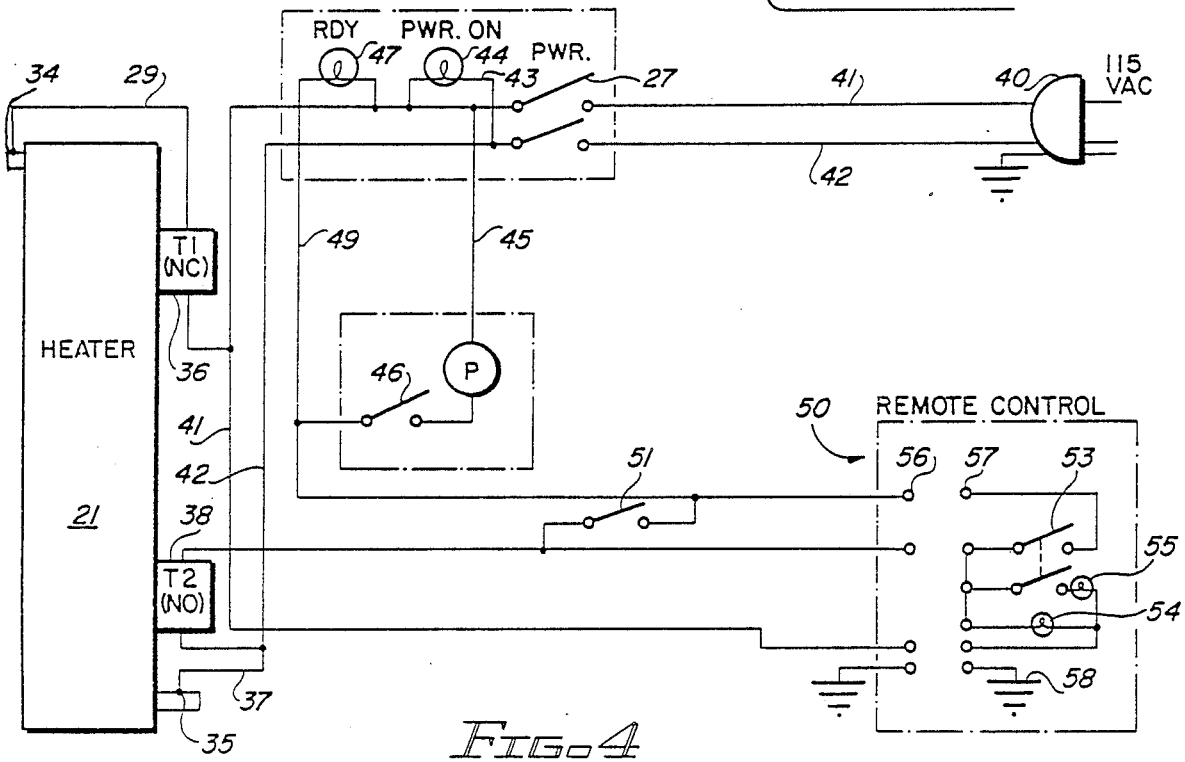
FIG. 4 an electrical diagram of an electrical circuit used in accordance with the smoke generator of FIGS. 1 through 3.

The coil 30 is specifically selected for its resistance over a specified length of tubing so that it can form an electrical resistance in an electrical circuit having an electrical connector 34 of one polarity at one end and an electrical connector 35 of an opposite polarity at the opposite end. Connector 34 is connected through a conductor as shown in FIG. 4 to a first thermostat 36 which is normally closed while the connector 35 is connected through a conductor 37 to a second thermostat 38 which is a normally open thermostat. An electrical plug 40 may provide an electrical voltage such as 115 volts AC through an a pair of conductors 41 and 42 and through a power switch 27 as shown in FIGS. 1 and 4. The power switch is connected through a conductor 43 to a power-on light 44 and is connected across the conductors 41 and 42 whenever the switch 27 is turned on. The conductor 41 is also connected to a conductor 45 to a pump 16 which has a switch 46 mounted thereto for actuating the pump 16 to pump a smoke generating liquid from the reservoir 13 through the pump 16 and into the heat generating tubing coil 30 when the pump 16 is actuated. A ready light 47 is connected from the conductor 41 when the power switch 27 is actuated and to the switch 46 to indicate when the pump is ready. The thermostat 36 is connected to the conductor 41 which is connected through the conductor 29 to the electrical connector 34 attached to one end of the coil 30 while the opposite power line 42 is connected to the opposite end 35 of the coil 30 and also is connected to a thermostat 38 which is a normally open thermostat. Thermostat 38 maybe connected to an optional remote control circuit 50 and through a switch or relay 51 which is normally closed and opens when the remote control 50 is connected to a switch 46 and to the pump 16. The remote control circuit 50 has a double throw relay switch 53, as well as a ready light 54 connected therein. One side of the switch 53 has a power-on light 55 and each side of the plug in connectors 56 and 57 has a ground conduit connector 58. Various electrical variations such as low voltage remote (i.e. 24 volts) utilizing conventional transformers and relays can be used without altering the basic operation of the smoke generator. The remote control 50 is plugged in and actuated with the switch 51 but may also be operated remotely using a transmitter and receiver.

In operation, a smoke generating material, such as a non-toxic and safe propylene glycol, is stored in the reservoir 13. The smoke agent is forced by the pump 16 and through the tube 20 to the resistance tube heating coil 30. An electrical voltage, which may be a 115 volt alternating current, is applied to the resistance tube 30 to conduct electrical current from one end 33 to the other end 32 of the resistance coil to generate heat within the tube when an electrical switch 27 is closed. An electrical resistance in the tube may be generated by ⅛ inch diameter tube having a wall thickness of 0.005 inches with a length between 20 to 35 feet depending upon the tube material. The material may be a stainless steel but the preferred material is an alloy of nickel, chromium and iron with columbium and molybdenum, such as INCONEL alloy 625 by Superior Tube Company. A preferred alloy may contain 20–23% chromium, iron (5% max), molybdenum 8–10%, nickel 58–63%, columbium and tantalum 3.15–4.15% and small amounts of carbon (0.10% max), silicon (0.50% max), manganese (0.50% max), phosphorus (0.015% max), and sulfur (0.015% max). The heat from the tube is transferred to the smoke agent material being fed thereto from the reservoir 13 and flowing through the resistance tube 30. The smoke agent material is heated until it reaches a superheated vapor state of approximately 50° F. above its boiling point. The superheated vapors are then ejected from the outlet orifice 33 at the hot end of the resistance tube 33 at approximately 40 lbs. psig and to the surrounding air where it condenses into smoke or fog particulates. The resistance tube coil 30 is coated with a type of electrical insulating material that has special high thermal conductivity properties. The preferred material is a special boron nitride coating, such as type V produced by Sohio, Carborundum Company, specifically for its high thermal conductivity. Thus, by using this material the metal tube coils are electrically isolated from touching each other to avoid short circuiting by the coating while providing a highly conductive thermal feedback path from the hot orifice end 33 of the heater tube 30 toward the cold inlet end of the tube 32. Since heat conduction can be considered proportional to its thermoconductivity value in a cross-sectional area of the flow path and inversely proportional to its path length, then the comparison of a coated and non-coated tube can be determined. The coating is sufficiently applied so that the adjacent coils are joined together to shorten the conduction path or coil length to about 12 inches when compared to a resistance tube length of 30 feet. The effective feedback of the heat flow through the coating material has been shown to be more than 400 times a non-thermal conductive coating. Thus without the thermal conductive coating, an increasing temperature gradient occurs as the smoke agent material becomes increasingly hotter until a maximum high temperature is reached at the smoke outlet end. This temperature then rises very quickly since very little heat can be conducted back through the thin wall resistance tube and a fast responding temperature control system is required while the addition of the thermal feedback coating 31 on the resistance tube 30 of the present invention permits heat generation within the resistance tube of the heat readily transferred to the smoke agent liquid. The temperature gradient along the coated tube, however, will tend to be more uniform or constant as compared to the non-conductive coating tube since heat transferred through the coating in one test was 420 times faster. Thus, the tendency is to equalize the temperature throughout the coating which tends to delay the temperature rise of the hot end of the tube. This in turn allows a simple thermostat or pair of thermostats 36 and 38 to be utilized for sensing the temperature and for operating the pump 46 responsive to the sensor temperatures and to eliminate much more complex solid state or other temperature controls. This is because thermostats are inexpensive electrical devices but which generally do not have the rapid response time that might otherwise be required. The smoke generator can be turned on with the switch 31 so that the tubes 30 become rapidly heated within seconds to thereby operate the pump 16 with or without a delay responsive to the thermostat reading of sufficient temperature to pump smoke agent material in the reservoir 13 into the coiled tube resistance heating element 30 to produce a smoke, fog, or aerosol out the outlet 33.

The Thermostat 36 is normally closed and applies power to the coiled tubing 30 whenever the switch 27 is actuated until the thermostat opens because the cold end of the coiled tube 30 exceeds a predetermined temperature. The thermostat 38 prevents the pump 16 from coming on when the hot end of the coil 30 is cold and is normally open until heat closes it. connecting the remote control 50 also allows remote control of the pump 16 by the switch 53.

A standby operation of the smoke generator is when the heater is operating but the pump is shut off and smoke is not being produced. Generally this is done at normal operating temperatures after a smoke generator has been pre-heated a required period of time and controlled by a heater thermostat. Hence, a repetitive preheat waiting time is avoided. Since their is no fluid flow during stand by, there is no temperature gradient which tends to reduce the amount of heat transfer to the smoke generator enclosure. Tests have shown as much as 60° F. temperature rise within the case during standby at normal temperatures.

Figure 5:
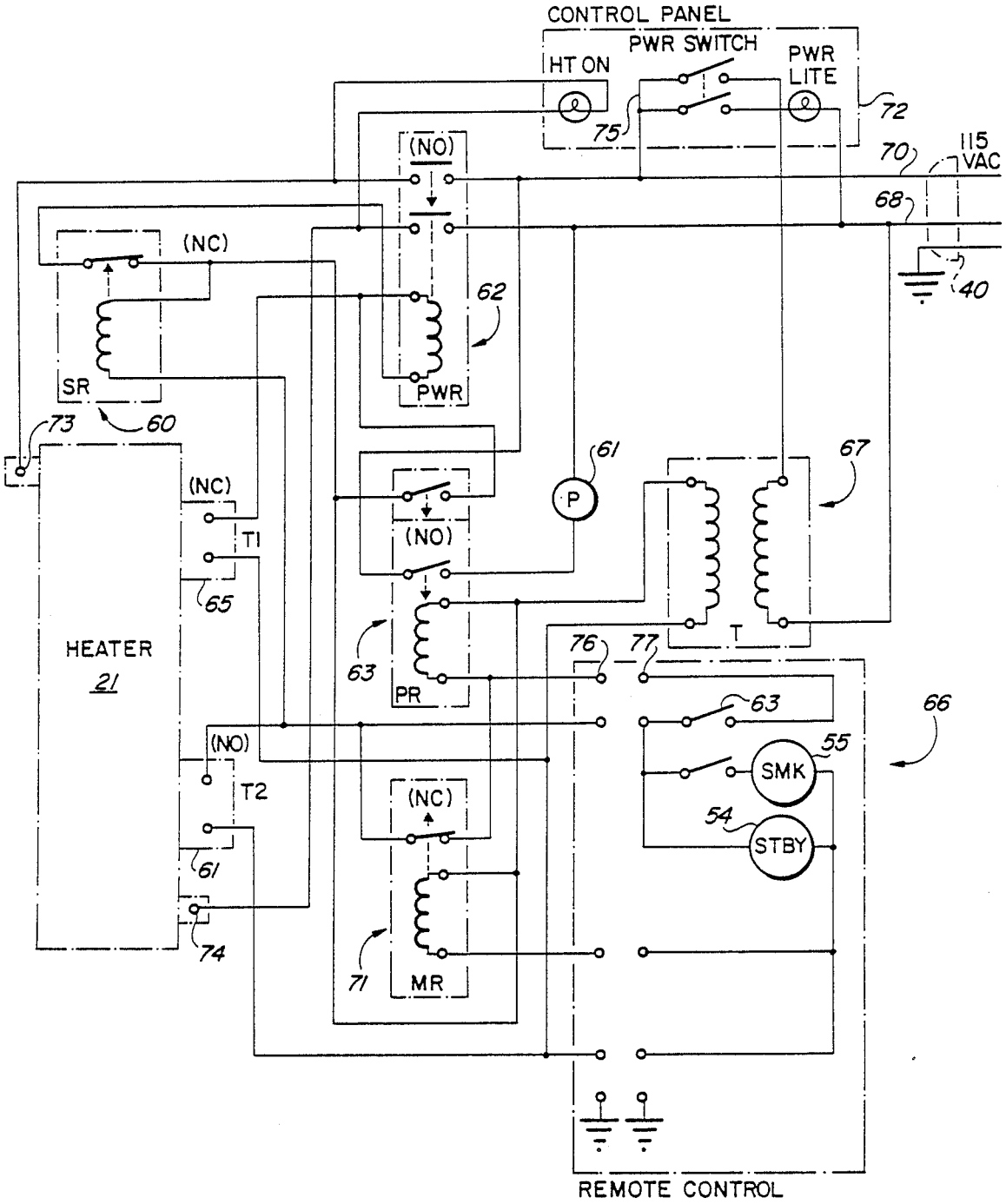
FIG. 5 is a second embodiment of an electrical diagram of an electrical circuit used in accordance with the smoke generator of FIGS. 1 through 3.

A "low-temperature" standby is possible due to the fast start up time capability, which in turn is due to the low thermal mass associated with the resistance tube approach. The low temperature pump thermostat can be utilized for this purpose as shown in the schematic of FIG. 5. Hence a low-temperature standby temperature rise would be about ½ (or about 30° F.) that of the normal standby temperature. This would be an advantage where high temperature environments are encountered and/or special cooling requirements, such as louvers or ventilation are to be avoided.

The electrical wiring diagram of FIG. 5 shows a normally closed (NC) standby relay (SR) 60 which is activated by the normally open (NO) low temperature pump thermostat (T2) 61. When a low temperature of 300° is reached, thermostat 61 closes and relay 60 opens which de-energizes a power relay 62 and cuts off the heater current in the heater coil 30 and the heater cools. When the heater cools below 300° the thermostat 61 opens and 60 closes, which causes relay 62 to close and the heater current is again flowing to start the cycle over again. When the smoke switch 63 in the remote control 66, is activated, then pump relay 63 is closed which activates the pump 16 and allows the heater thermostat 65 to control the normal operating temperature of 480°-500°.

A low voltage transformer 67 is connected to the power lines 68 & 70 allows for the use of 24 volt relays and thermostats to activate 115 volt power to the heating element coiled tube 30.

A normally closed relay 71 is connected to the remote control 66 and is also connected from the transformer 67 to operate at 24 volts through the control remote control 66. This circuit has a control panel 72 operating in the same manner as shown in FIG. 4 to apply power to connection 73 at one end of the heating tube 30 and power at contact 74 at the other end of the heating tube 30. Responsive to the power switch 75 in the control panel 72 for the remote control switch 63 and the remote control 66, when it is plugged into the connector 76 with its connector 77. Thermostat 65 and 61 still control the heating of the heating element tube 30 as well as the operation of the pump either directly through the control panel 72, switch 75 or remotely through the remote control 66 switch 63. The addition of the standby relay 60, power relay 62, pump relay 63 and remote control relay 71 allow for a low-temperature standby of the smoke generator and allows the coil to be preheated along with the coating and insulated container for instant operation upon actuation of the pump 16.

An alternate wireless radio frequency remote control can be used because of the resistance tube fast heating time feature. A unit such as a radio transmitter and receiver can turn the system on and off by connecting the remote control receiver to a power source and to the 15 volt receiver relay. Smoke is generated upon activating the wireless transmitter and tests have shown that smoke is produced within 30 seconds. A low temperature standby feature can also be incorporated by adding a simple programmed timer to turn the receiver relay switch on momentarily for 10 second pulses every 5 minutes. In this case smoke would be produced essentially instantaneous when power is applied by activating the transmitter for continuous operation.

It should be clear at this point that a smoke, fogger, or aerosol generator has been provided which permits the use of low cost thermostats in place of expensive solid state temperature controls while still providing for a fast startup feature of a resistance tube smoke generator. The system provides low temperature difference between heating surfaces and the smoke agent vapor temperature and avoids the need for ventilation cooling or louvers and allows a system to be maintained in a water-tight case and to provide for the utilization of a wide variety of smoke agents. However, the present invention is not to be construed as limited to the forms shown which are to be considered illustrative rather than restrictive.

I claim:

1. A smoke generator comprising:

A housing;

an electrical power source;

an electric pump mounted in said housing and connected to said electrical power source;

a fluid reservoir mounted in said housing and operatively connected to said pump;

a coiled electrical resistance heating tube mounted in said housing and forming an electrical resistance in an electrical circuit, said coiled electrical resistance heating tube having a thin coating of an electrical insulating, thermal conducting material thereon, said coating containing a boron nitride therein, said coating electrically isolating said coils of said coiled electrical resistance heating tube and conducting heat between cold and hot ends of said coiled electrical resistance heating tube and said coiled electrical resistance heating tube having one end operatively connected to said pump;

smoke outlet means located at another end of said coiled electrical resistance heating tube for directing heated fluid generated in said coiled electrical resistance heating tube therefrom;

sensing means for sensing temperature in at least one position in said coiled electrical resistance heating tube and being positioned adjacent to one end of said coiled electrical resistance heating tube; and switching means for switching said pump on and off responsive to said sensing means sensing predetermined temperatures, whereby smoke is generated in said coiled electrical resistance heating tube upon said tube reaching a predetermined temperature and said pump being switched on to pump fluid from said reservoir through said coiled electrical resistance heating tube.

2. A smoke generator in accordance with claim 1 in which said comprises coating powdered boron nitride in a binder.

3. A smoke generator in accordance with claim 1 in which said coating comprises powdered boron nitride in a binder of aluminum phosphate.

4. A smoke generator in accordance with claim 1 in which said coating comprises 70% to 90% powdered boron nitride in a binder.

5. A smoke generator in accordance with claim 1 in which said coiled electrical resistance heating tube is made of an alloy of nickel, chromium, and iron.

6. A smoke generator in accordance with claim 1, in which said coiled electrical resistance heating tube is made of stainless steel.

7. A smoke generator in accordance with claim 1, in which said coiled electrical resistance heating tube mounted in said housing is mounted in an insulated container to retain heat from said coiled electrical resistance heating tube therein.

8. A smoke generator in accordance with claim 7 in which the sensing means for sensing the temperature in at least one position in said coiled electrical resistance heating tube is an electrical thermostat.

9. A smoke generator in accordance with claim 8 in which the sensing means for sensing the temperature in at least one position in said coiled electrical resistance heating tube includes two electrical thermostats one said thermostat being positioned adjacent each end portion of said coiled electrical resistance heating tube for sensing the temperature in each end portion of said coiled electrical resistance heating tube.

10. A smoke generator in accordance with claim 7 in which an electrical switch is mounted on said housing and connected in a power line from said power source to connect and disconnect said power source to said coiled electrical resistance heating tubes.

11. A smoke generator in accordance with claim 10 in which one said thermostat actuates said coiled electrical resistance heating tube.

12. A smoke generator in accordance with claim 11 in which a second of said thermostats actuates said electric pump in said housing to supply fluid in said fluid reservoir to said heating tube.

13. A smoke generator in accordance with claim 12 having a connector for a remote control mechanism.

14. A smoke generator in accordance with claim 13 having a remote control mechanism for connecting to said connector for a remote control for actuating said smoke generator remotely.

15. A smoke generator in accordance with claim 14 in which said remote control mechanism has a switch therein connecting said other thermostat therethrough to said electric pump for actuating said pump remotely.

16. A smoke generator in accordance with claim 15 in which said casing has a power on light coupled to said power line and a ready light coupled across said pump and mounted there said casing whereby visual inspection is provided of the condition of said smoke generator.

17. A smoke generator comprising:

A housing;

an electrical power source;

an electric pump mounted in said housing and connected to said electrical power source;

a fluid reservoir mounted in said housing and operatively connected to said pump;

a coiled electrical resistance heating tube mounted in said housing and forming an electrical resistance in an electrical circuit, said coiled electrical resistance heating tube having a thin coating of an electrical insulating, thermal conducting material thereon, said coating containing boran nitride and electrically isolating said coils of said coiled electrical resistance heating tube and conducting heat between cold and hot ends of said coiled electrical resistance heating tube, said coiled electrical resistance heating tube having one end operatively connected to said pump;

smoke outlet means on an other end of said coiled electrical resistance heating tube for heated fluid generated in said coiled electrical resistance heating tube therefrom;

sensing means for sensing temperature in at least one position in said coiled electrical resistance heating tube and being positioned adjacent thereto;

switching means for switching said pump on and off responsive to said sensing means sensing predetermined temperatures, whereby smoke is generated in said coiled electrical resistance heating tube upon said tube reaching a predetermined temperature and said pump being switched on to pump fluid from said reservoir through said coiled electrical resistance heating tube; and thermostat control means having first and second thermostats, the first thermostat being normally closed and opening upon one end of said coiled electrical resistance heating tube reaching a predetermined temperature and the second thermostat being normally open to block the operation of the electrical pump until the other end of said coiled electrical resistance heating tube reaches a predetermined temperature.

18. A smoke generator in accordance with claim 17 in which said coating comprises powdered boron nitride in a binder.

19. A smoke generator in accordance with claim 18 in which said coiled electrical resistance heating tube is made of nickel, chromium and iron, columbium and molybdenum.

20. A smoke generator in accordance with claim 19 which said coiled electrical resistance heating tube mounted in said housing is mounted in an insulated container to retain heat from said coiled electrical resistance heating tube therein.

21. A smoke generator in accordance with claim 17 in which said coiled electrical resistance heating tube is made of stainless steel.

22. A smoke generator in accordance with claim 17 having a low voltage relay connected to said electric power source and for operating a plurality of low voltage relays for operating said smoke generator, said coiled electrical resistance heating tube mounted in said housing is mounted in an insulated container to retain heat from said coiled electrical resistance heating tube therein.

* * * * *